United States Patent [19]

Loftus

[11] 4,419,978

[45] Dec. 13, 1983

[54] BREATH OPERATED DART APPARATUS INCLUDING PLASTIC FOAM QUIVER MEANS

[75] Inventor: Nolan M. Loftus, Ogden, Utah

[73] Assignee: Dynatec International, Inc., Salt Lake City, Utah

[21] Appl. No.: 375,292

[22] Filed: May 5, 1982

[51] Int. Cl.[3] ..... F41B 1/02

[52] U.S. Cl. ..... 124/62; 124/41 R; 124/45

[58] Field of Search ..... 124/62, 41 R, 45, 83, 124/88, 23 A, 24 A, 80; 273/416, 428, 419, 420, 423, DIG. 7

[56] References Cited

U.S. PATENT DOCUMENTS

| | | | |
|---|---|---|---|
| 2,679,838 | 6/1954 | Thompson | 124/62 |
| 2,694,661 | 11/1954 | Meyer | 273/DIG. 7 |
| 2,821,397 | 1/1958 | Hartigan | 124/62 X |
| 3,114,485 | 12/1963 | Whiffen | 124/23 A X |
| 3,137,287 | 6/1964 | Arbun | 273/416 X |
| 3,266,806 | 8/1966 | Warren et al. | 124/62 X |
| 3,388,696 | 6/1968 | Hoverath et al. | 124/62 |
| 3,735,748 | 5/1973 | Gaylord | 124/62 |

OTHER PUBLICATIONS

Popular Science, *Hunter Uses Blowgun to Kill Game,* 2/39, p. 142.

*Primary Examiner*—Richard T. Stouffer
*Assistant Examiner*—William H. Honaker
*Attorney, Agent, or Firm*—A. Ray Osburn

[57] ABSTRACT

A blowgun assembly and associated darts capable of long range accurate target application, comprising an elongate launching tube of exceptionally light weight, high rigidity, and dimensional stability along with an associated mouthpiece and a dart quiver affixed to the tube. The darts comprise a metallic wire shaft with an affixed bulbous member at the rear end which serves as an air piston for dart propulsion and also as a stabilizing member during flight of the dart. The blowgun is proportioned so that the dart is propelled by a brief comfortable puff of air into the mouthpiece by the user, without significant strain. Therefore the blowgun assembly is extremely comfortable to use and very accurate so that its sporting use in very enjoyable.

3 Claims, 10 Drawing Figures

BREATH OPERATED DART APPARATUS INCLUDING PLASTIC FOAM QUIVER MEANS

BACKGROUND OF THE INVENTION

1. Field

The field of the invention is breath operated blowguns and darts and more particularly those adapted for sporting target use.

2. State of the Art

Relatively crude breath operated dart guns are common in primitive societies as hunting weapons for game, the larger game generally requiring a poisoned dart for lethal effect. These devices, are made from naturally occurring materials and are of limited range and accuracy. Certain primitive blowguns are known to be constructed of two pieces of wood, each semicircularly grooved and subsequently joined by glue to provide an elongate bore of approximately uniform diameter. These devices tend to have rough bores, spoiling dart velocity and range. Further, they are easily damaged by rough handling, and are susceptible to moisture and heat warpage. The projectiles are best characterized as miniature arrows, having elongate wooden shafts and feather stabilizers. They are not efficiently launched by the breath of the user. Launching tubes of steel, copper, or aluminum are similarly not suitable for long range and high accuracy. They are either excessively limber or too heavy for accurate aiming, tubes with thin walls for acceptable weight being too limber and further easily dented and bent. The cost of more rugged, highly tempered metal is prohibitive. Extruded tubes of unreinforced plastic are similarly fragile and are not sufficiently stable dimensionally, tending to warp or flatten with the passage of time, becoming unuseable, or at least of reduced range and accuracy. Launching tubes constructed by winding of resin impregnated filament tape about an elongate mandrel are stronger and more stable, but are also quite expensive. Very expensive composite launch tubes of plastic with an outer shell of metal, although quite rigid, are too heavy for the easy handling needed for accurate target use.

The conventional feather stabilized dart is not well adapted for maximum range and accuracy. The feather members, longitudinally aligned and presenting minimum frontal area, inefficiently utilize the propulsive power of the expelled air, since the air flows largely unused around the stem through the spaces between the feather elements. The feather elements cause unwanted friction within the launching tube, shortening the range. They are fragile and therefore not well adapted to repeated use. The shafts are of wood or plastic, and must be, for strength and dimensional stability, of relatively large diameter, and contribute substantially to aerodynamic drag, shortening the range.

These shortcomings in the prior art have long frustrated efforts to produce easily handled dart blowguns sufficiently accurate for target use capable of manufacture at reasonable cost.

BRIEF SUMMARY OF THE INVENTION

With the foregoing in mind, the disadvantages of prior art blowguns are eliminated or substantially alleviated by providing an exceptionally suitable barrel made possible by the discovery of a tube construction unexpectedly exhibiting virtually every property needed for extremely accurate long range dart propulsion. Also provided are associated darts unusually adapted for launch from the tube into stable long range flight, by a brief comfortably provided puff of air.

Preferably, the launching tube is proportioned to efficiently utilize the dart launching breath, so that there is no strain upon the user even at long ranges. The exceptional rigidity and light weight of the launching tube assures accurate, predictable aiming. The unexpectably suitable tube construction, not heretofore used or suggested by the prior art, comprises a "pultruded" tube of resin impregnated filaments. The pultruded tube comprises multiple filaments of glass or other materials impregnated with cured resin. Such a tube is constructed by immersing loosely wound rope of the filaments into a reservoir of the resin, inserting the end portion of the rope about a cylindrical mandrel, and drawing it about the mandrel through an external diameter forming die to extrude excess resin and compact the filaments together. The resin is subsequently oven cured to provide the final pultruded tube.

The blowgun may be operated by the engagement of the lips about the near end of the launching tube. However, it is advantageous for purposes of sanitation and aesthetics to provide an enlarged mouthpiece at the launching end of the tube adapted to contact the face of the user about his mouth, to avoid the transfer of saliva from one user to the next.

The blowgun preferably further incorporates a dart holding quiver of elastic foam affixed, preferably slideably, to or about the exterior of the launching tube, the darts being pierced into the foam.

It is therefore a principal object of the invention to provide dart blowguns and associated darts for enjoyable, accurate target use not heretofore found in the art. Other principal objects include providing such equipment which is exceptionally durable and rugged and economical to manufacture. Other objects include the provision of sanitary mouthpiece means and convenient dart carrying means of very light weight.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
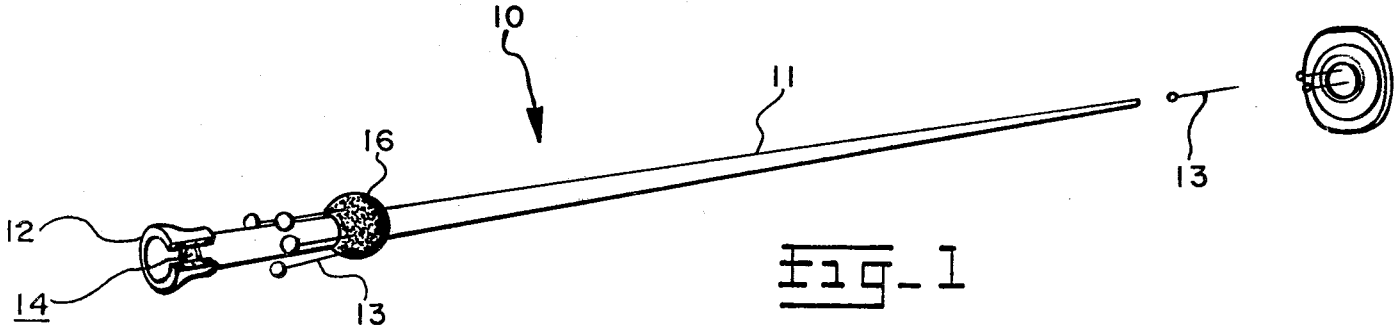
FIG. 1 is a perspective representation, drawn to a reduced scale, of a dart blowgun in accordance with the invention thereof, shown as if in target use, FIG. 2 a longitudinal cross section of fragments of the blowgun of FIG. 1, drawn to substantially full scale, FIG. 3 a transverse cross sectional view of the blowgun of FIG. 2 taken along line 3—3 thereof, FIGS. 4–8 perspective representations of dart stabilizer bulbs representing five configurations thereof, drawn to the scale of FIG. 2, FIG. 9 a representation of the dart in flight, showing the aerodynamic stabilizing forces thereon, drawn to the scale of FIG. 2, and FIG. 10 a schematic representation of a pultrusion process for fabricating the launch tube of the blowgun, drawn to a reduced scale.
Figure 2:
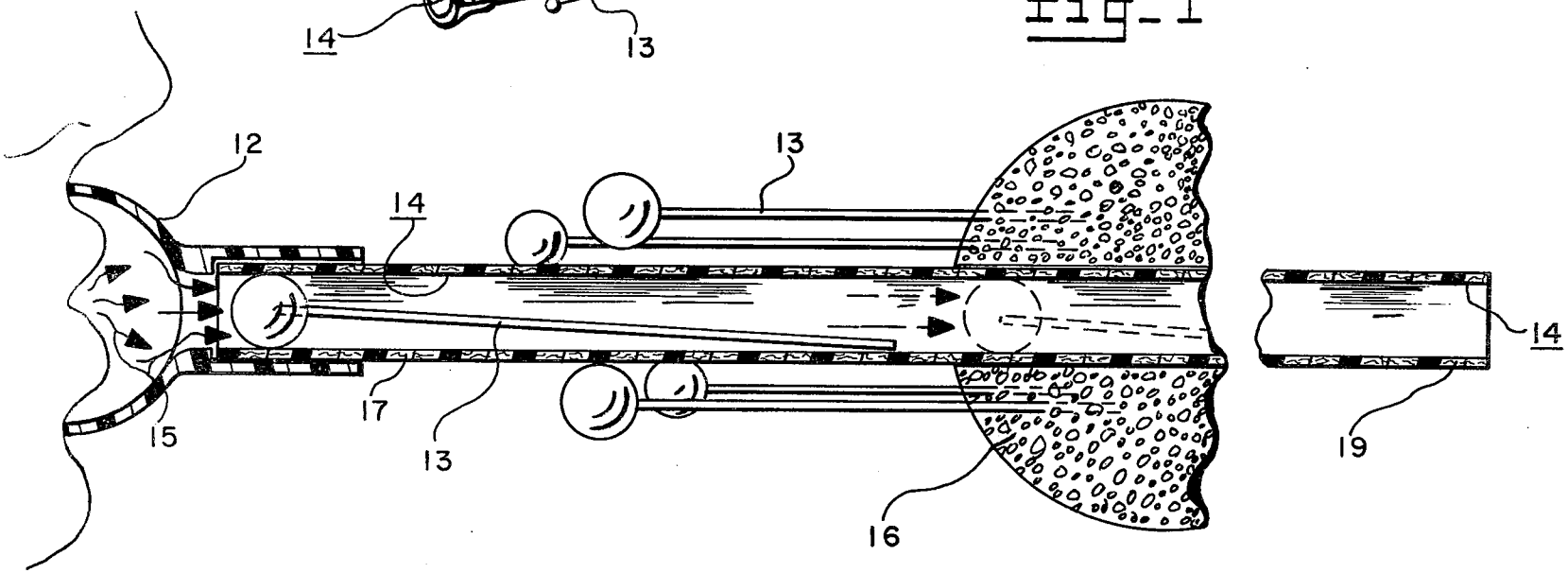
Figure 3:
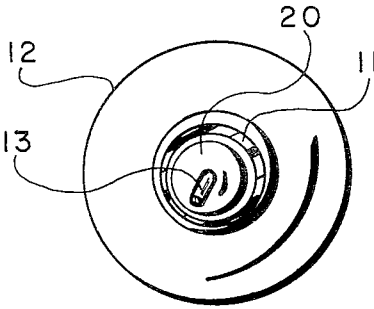
Figure 4:
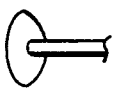
Figure 5:
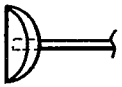
Figure 6:
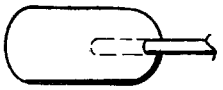
Figure 7:
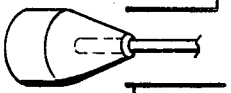
Figure 8:
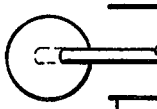

The long range dart blowgun 10 (FIGS. 1–3) comprises an elongate cylindrical launching tube 11, a mouthpiece 12, and an associated dart assembly 13 adapted for launch through bore 14 of tube 11 by air (Arrows 15) expelled from the lungs of the user. A dart holding quiver 16 may be affixed to launching tube 11.

Dart assembly 13 is inserted within bore 14 with stabilizer/piston ball 20 at the mouthpiece end 17 of launching tube 11, with shaft 18 resting in bore 14 toward exit end 19. Ball 20, sized for unimpeded passage through bore 14, is impelled along with shaft 18 through and out of bore 14 by a puff of air 15 from the mouth of the user. Preferably, the diameter of ball 20 is such that it substantially but loosely fills bore 14 so that it is impelled with substantially the full force of air 15 upon its rearwardly disposed surface 21, with negligible leakage of air therearound. Smaller stabilizer/pistons 20 may be employed with less efficiency of propulsion, and correspondingly decreased exit velocity and range.

Figure 9:
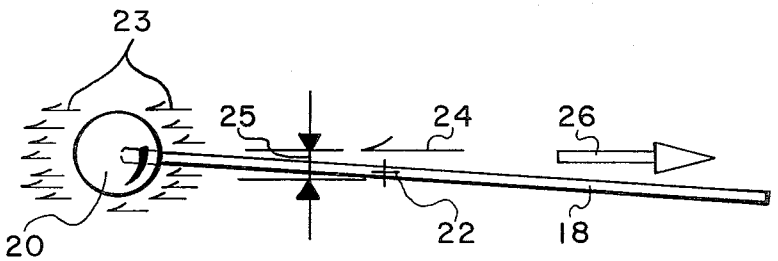

After ejection from tube 11, dart 13 is stabilized in flight by ball 20, the aerodynamic drag thereon providing a straightening moment about the dart assembly center of gravity 22. (FIG. 9) Shaft 18 need not be aligned with the axis of bore 14 during launch, since dart 13 is immediately aligned with its flight path when it becomes airborne. It is important that shaft 18 be of small diameter compared to that of ball 20, so that the air resistance in flight is concentrated predominantly upon ball 20. Also, the total weight of ball 20 is preferably substantially less than that of shaft 18, so that the center of gravity 22 is well removed forwardly from ball 20, to assure a substantial stabilizing moment in flight. Flight attitude corrections are applied to even very minor deviations. FIG. 9 shows the resultant aerodynamic drag 24, the stabilizing moment arm 25 and the flight direction 26. Shaft 18 is preferably of metallic wire, having a very small diameter compared to that of ball 20, along with the rigidity needed to penetrate targets efficiently. Of the metallic wires and rods, music wire is most desirable, being highly tempered and resistant to permanent bending or kinking.

The piston/stabilizers 20 may be of various bulb-like shapes including cylindrical, conical, cylindrical with conical, spherical or elliptical leading end portions or even disc-like shapes including dished shapes preferably concave in the direction of flight. (FIGS. 4–8) Preferably, the stabilizers 20 are constructed as solids of lightweight materials such as plastics, wood, cork, or even paper. However, metals may be utilized in the disc shapes, and in other shapes in the form of lightweight shells. (not illustrated) Aerodymanic characteristics vary somewhat with shape, but all serve as effective stabilizers. With all configurations, dart 13 is stabilized substantially by the rearwardly directed aerodynamic drag (Arrows 23, FIG. 9), rather than by laterally directed lift as would be provided by feather-like configurations.

Launch tube 11 is sized and proportioned for substantially effortless, long range, breath propulsion of dart 13. Tubes 11 of excessive diameter cause the dissipation of the velocity and pressure of the expelled air, decreasing the resulting acceleration and final velocity of dart 13. Oversized launch tubes require correspondingly large piston/stabilizers 20 which have greater drag in flight and further decrease range. Unduly small tubes, on the other hand restrict the free flow of air from the lungs, causing uncomfortable back pressure within the mouth and lungs and restricting the flow of propulsive air. Thus, launching tubes 11 of intermediate diameter are greatly preferred for sporting target blowguns, since they provide greater range and can be operated with greater enjoyment. Preferred bore 14 sizes range from about 5/16 to $\frac{5}{8}$ inches in diameter, with $\frac{1}{4}$ to $\frac{3}{4}$ inch being approximately the satisfactory limits.

Launch tube length is important to range, accuracy and user enjoyment. Excessively long tubes have greater internal volume, and may require uncomfortably long bursts of expelled breath to propel the dart through the tube. For higher exit velocity, dart 13 is preferably positively urged the full length of launching tube 11 so that its velocity is not frictionally reduced before exit. Conversely, if launch tube 11 is too short, dart 13 is not fully accelerated before being expelled, and the full propulsive power of the comfortably expelled breath is not utilized. Within the above discussed range of bore diameters, launch tube lengths ranging from approximately 4 feet to approximately 7 feet have proven to be most desirable.

Dart launching tubes have previously been constructed of a wide variety of materials. Weight, rigidity, dimensional stability, economy of manufacture, and resistance to moisture and impact are recognized important factors in the selection of the material. All of the previously used state of the art materials require the designer to seriously sacrifice desirable blowgun characteristics, none of the available materials exhibiting all or even the majority of the desirable characteristics. None of the state of the art materials have permitted the construction of a durable, economical blowgun accurate enough, and sufficiently easy to use, for target use, especially at long ranges. Long, small diameter bores 14 are difficult to fabricate from wood to the straightness and smoothness required. Impact and moisture resistance are both less than desirable. Prefabricated metal tubes must be quite thin for acceptably low weight. They are easily dented or permanently bent, and are too limber in lengths required. Any local denting or permanent bending renders the blowgun 10 useless. Aiming is difficult because of the gravity induced curvature when the tube is held cantilevered horizontally. The metal tube may oscillate during the aiming process. Any appreciable curvature increases the frictional resistance to dart 13, since it must be propelled along the curving bore. Tubular members 11 of synthetic extruded plastics fulfill the general requirements of lightness of weight, and are generally economical. However, shelf and temperature dimensional stability are generally not sufficient. They are easily broken, especially if formulated for sufficient hardness. If formulated for less hardness, they are easily flattened or bent. Mandrel wrapped tubes 11 of resin impregnated filament tape are rugged and have good dimensional stability. They are, however, basically quite expensive, and do not without additional expensive operations have the exterior smoothness required for cosmetic appeal.

Figure 10:
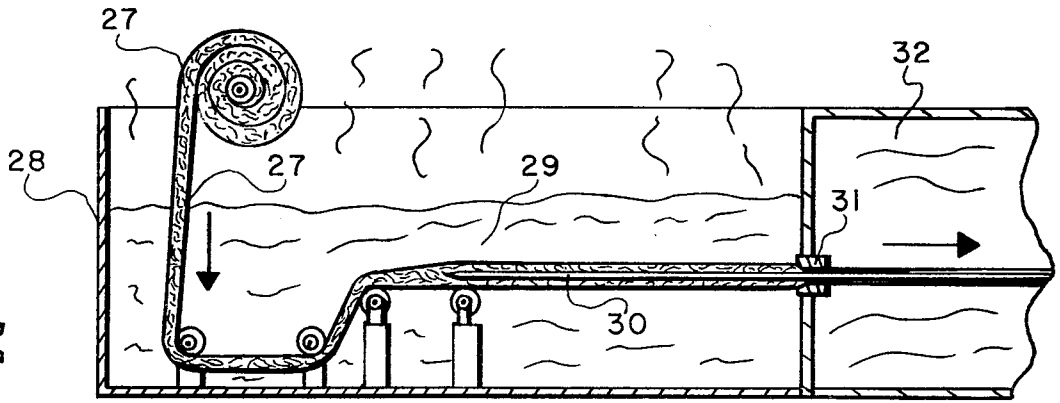

The inventor has discovered a launch tube construction previously unused and not suggested in the art, which has virtually none of the previously discussed shortcomings in the state of the art materials. This new material does in fact unexpectedly permit the design of a comfortably operated, accurate, dart blowgun capable of target ranges in excess of 60 feet. State of the art blowguns, on the other hand, are notoriously inaccurate at any range over about 15 feet. The new construction comprises a "pultruded" tube 11 of glass or carbon filaments in a matrix of cured resin. This construction fulfills virtually all the previously discussed requirements for launch tube 11. It is of very low density (0.069 lbs./cu. in.) and can therefore have substantial wall thickness to avoid limberness while remaining of comfortably aimed weight. Aiming is easily accomplished without significant sag or curvature, the modulus of elasticity of the resin/filament matrix material being $5.3 \times 10^6$ lbs./in$^2$. The bore is exceptionally smooth and does not require smoothing operations. The ruggedness of the tube is outstanding, the tensile strength of the pultruded material being over twice that of steel. Tubes of this construction are virtually indestructible with normal rough useage, not subject to local denting or flattening, and can withstand extremely high impact and bending stresses. Yet the pultruded construction is more economical than most alternative materials. The "pultrusion" process involves the impregnation of prefabricated loosely wound ropes of the filaments with liquid resin (FIG. 10). The filament rope 27 is immersed in a reservoir 28 of liquid resin 29 and, when the filaments are thoroughly coated with the resin, is threaded upon an elongate metallic mandrel 30 and drawn thereabout through an outside diameter forming die 31 in an exterior wall of the reservoir 28 into a resin curing oven 32. Die 31 squeezes out excess resin 29 and compresses the filaments together radially into a compact mass. When resin 29 is subsequently cured, the filaments are bound together in a matrix of cured resin to act as a structural tubular unit of great strength and rigidity, exceptionally suitable for launch tube 11.

Mouthpiece 12, bulb or funnel shaped to fit around the lips and direct the expelled air into tube 11, is advantageously made of plastic, rubber or the like and adapted to frictionally engage end 17 of launch tube 11. Blowgun 10 is entirely functional without mouthpiece 12, but less desirable for aesthetic and sanitary reasons. Quiver 16 is advantageously of low density resilient foam with tube engaging bore **16*b* sized to lightly grip tube 11, so that quiver 16 is easily slideable to the user preferred location. The foam of quiver 16 is easily pierced by the shafts 18 of darts 13**, and its weight is desirably negligible.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A breath operated dart apparatus comprising:

an elongate, open ended tube adapted at one end thereof to receive air expelled from the lungs and mouth of the user;

elongate dart means adapted to be launched through and from the bore of the launching tube by the expelled air; and dart quiver means adapted for securement to the launching tube, wherein the quiver means comprises plastic foam means having a bore therethrough for slideable frictional securement of the quiver means about the launching tube.

2. The apparatus of claim 1, wherein:

the launching tube comprises plastic tubing.

3. The apparatus of claim 2, wherein:

the launching tube comprises pultruded tubing of elongate glass filaments in a cured resin matrix.

* * * * *